United States Patent [19]

Elliston

[11] 4,200,054

[45] Apr. 29, 1980

[54] STABILIZED HOIST RIG FOR DEEP OCEAN MINING VESSEL

[76] Inventor: Thomas L. Elliston, 6000 E. Berry St., Ft. Worth, Tex. 76119

[21] Appl. No.: 748,839

[22] Filed: Dec. 10, 1976

[51] Int. Cl.[2] ..... B63B 35/44

[52] U.S. Cl. ..... 114/264; 166/355

[58] Field of Search ..... 114/256, 264, 265, 121, 114/122; 61/86; 166/0.5; 175/7, 8, 27, 85; 37/72, 58; 254/139.1; 308/3 R, 2 R, 2 A; 244/175, 177

[56] References Cited

U.S. PATENT DOCUMENTS

| | | | |
|---|---|---|---|
| 3,163,239 | 12/1964 | De Vries et al. | 175/7 |
| 3,390,654 | 7/1968 | Bromell et al. | 114/264 |
| 3,468,282 | 9/1969 | Wintercorn | 114/122 |
| 3,471,108 | 10/1969 | Corso | 244/175 |
| 3,581,506 | 6/1971 | Howard | 175/7 |
| 3,941,433 | 3/1976 | Dolling et al. | 308/2 R |

*Primary Examiner*—Charles E. Frankfort

*Assistant Examiner*—Jesus D. Sotelo

*Attorney, Agent, or Firm*—Hubbard, Thurman, Turner, Tucker & Glaser

[57] ABSTRACT

A stabilized hoist rig for lowering, lifting, and supporting a pipe string from a vessel or floating platform in a deep ocean is disclosed. A resilient bearing member is disposed in load supporting relation intermediate the vessel and the hoist rig. A powered system is provided for angularly displacing the hoist rig with respect to the vessel to maintain vertical alignment of the hoist rig with respect to the pipe string as the vessel rolls and pitches during pipe stabbing and removal operations. In a preferred embodiment, the pipe string is supported by a slip bowl and a second resilient bearing member disposed intermediate the slip bowl and the hoist rig, and a system is provided for locking the hoist rig in a fixed position with respect to the vessel for permitting the vessel and hoist rig to roll and pitch with respect to the slip bowl in response to movements of the ocean in a passive support operating mode.

13 Claims, 6 Drawing Figures

STABILIZED HOIST RIG FOR DEEP OCEAN MINING VESSEL

BACKGROUND OF THE INVENTION

1. Field of the Invention

The invention generally relates to underwater mining systems and in particular to a stabilized hoist rig for lowering, lifting, and supporting a pipe string from a deep ocean mining vessel.

2. Description of the Prior Art

The potential of the ocean for supplying important and basic raw materials is generally recognized. Mining operations for sand, gravel, shell, heavy sands and other materials from continental shelf deposits are presently being performed by dredging techniques. On the ocean floor in deeper waters are vast quantities of mineral reserves. The primary mineral resources presently known are metalliferous deposits of zinc, copper, silver, lead, manganese and phosphate. Exploitation of these minerals is limited primarily by the technology of their recovery of delivery to the surface of the ocean. Among these deposits are mineral concentrations spread over large areas of the ocean floor in the form of nodules. The existence of nodules on the ocean bottom has been known for many years and are believed to be formed over aeons of time due to the precipitation out of the seawater of mineral substances. These nodules are known to consist essentially of iron oxide, manganese oxide, copper, cobalt and nickel, and are generally found in the deep areas of the sea where the floor is relatively hard and flat. The areas in which the nodules are known in sufficient quantities to sustain a profitable mining operation are found generally more than 200 miles off shore and at depths up to 18,000 feet and more.

Among the numerous systems which have been conceived for the recovery of nodules from the ocean floor is the hydraulic system which generally consists of a length of pipe which is suspended from a floating platform or vessel. The system includes a gathering head which is designed to collect and winnow the nodules from the ocean floor sediments and transport them through the pipeline. Means are provided for causing the water inside the pipeline to flow upward with sufficient velocity to suck the nodules into the system and transport them to the surface.

One of the major problems associated with this mining method is the bending stress induced in the pipe string by the pitch and the roll of the support vessel in response to wave movements of the ocean. Another complex problem is that of aligning a hoist rig with the pipe string for pipe stabbing and removal operations during lowering and lifting of the pipe string. A related problem is that of minimizing axial stresses induced by the sudden acceleration and deceleration of the pipe string during lowering and lifting operations.

Nearly vertical vacuum pipe strings, designed to elevate ore nodules from the ocean floor to a transport ship, can become dynamically unstable and fail within certain ranges of the following system parameters: damping of the pipe string; axial tension; ratio of the flow rate to the fundamental pipe string frequency; ratio of the pipe string mass to the contained flowing mass of ore and water mixture; the support vessel motion as it affects pipe tension and end displacement; pipe string inclination angle; and vortex forces caused by the ship's speed and ocean currents. Axial tension in the pipeline is adversely affected by the lifting and lowering operations of the pipe string into the ocean when it becomes necessary to decelerate the pipe string to a stop on the rig floor so that a new length of pipe may be added to or taken from the string. Sudden jaring stops can easily over-stress the pipe string in tension causing premature failure. Such a failure in the pipe string would delay mining operations for an indefinite period of time, and such damage would probably require replacement of the line.

These problems have been minimized in the past by designing special support vessels which do not react significantly to wind and wave action and by limiting the water depth in which these vessels operate. One such design is disclosed in U.S. Pat. No. 3,522,670. However, as the search for ocean mineral deposits advances into deeper waters where increased wave action induces higher roll and pitch reactions in the support vessel, and the length of the pipe string increases to reach abyssal depths, it becomes imperative to minimize the bending action induced in the pipe string and to minimize axial stresses induced into the pipe string by lowering, lifting, and maneuvering operations.

SUMMARY OF THE INVENTION

It is an object of the present invention to provide apparatus for dynamically positioning a hoist rig in vertical alignment with a pipe string which is pendulously supported from a floating vessel in order to accommodate pipe stabbing and removal operations and to minimize bending stresses induced into the pipe string by pitching and rolling movements of the vessel.

It is a further object of the present invention to provide a load supporting resilient bearing apparatus for minimizing the axial stresses induced into the pipe string by the accelerations and decelerations associated with pipe stabbing and pipe removing operations performed during the launching and recovery of the pipe string.

According to one aspect of the present disclosure, the invention may be practiced in combination with a floating platform of the type including a deck and having a well opening extending therethrough to provide access to the ocean beneath the platform. A vertically extending mast structure is provided which has a base member disposed over the well opening for supporting the pipe string as it hangs pendulously in the ocean. The mast structure is also equipped with hoist means for traversing the mast structure which includes means for engaging a section of pipe to be stabbed into the pipe string during a lowering operation or to be removed from the pipe string during a lifting operation. A resilient bearing member is disposed intermediate the base member and the deck of the vessel and in load supporting engagement with the base member for permitting angular displacement of the mast structure relative to the deck, and hydraulic power means are provided for moving the base member angularly about the resilient bearing member to maintain substantially parallel alignment of the mast structure with the vertical axis of the pipe string as the floating platform rolls and pitches in response to wave movements of the ocean.

In an alternate embodiment of the invention, the hoist rig includes a slip bowl for selectively engaging a peripheral surface portion of an upper joint of the pipe string, and a second resilient bearing member is disposed in load supporting engagement intermediate the slip bowl and the base member for permitting angular displacement of the base member about its roll and pitch axes relative to the slip bowl. In this embodiment, means are also provided for locking the base member in a fixed position relative to the platform to permit the mast structure to roll and pitch with respect to the slip bowl in response to movements of the ocean in a non-powered, passive support operating mode.

Angular movement and dynamic positioning of the base member and mast structure are provided by electromechanical control means which includes a pair of electromechanical transducers for generating attitude signals proportional to the roll and pitch angular displacements of the base member, electronic circuit means for generating position corrections signals proportional to the first and second attitude signals, and hydraulic actuators which are responsive to the position correction signals to angularly displace the base member about its roll axis and pitch axis relative to the floating platform to maintain substantially parallel alignment of the mast structure with the axis of the pipe string. Close alignment of the hoist rig with the pipe string is required during pipe handling to prevent cross-threading of the pipe joints.

According to a preferred embodiment, the bearing members each comprise an annular sector of a substantially spherical laminated body of superposed layers of an elastic material and a relatively inelastic material, each bearing being disposed substantially concentrically about a common center of rotation. Axial tension caused by vertical acceleration and deceleration of the pipe string are minimized by the resiliency of the bearing members which have a suitable axial spring constant to serve as a shock absorber to cushion the impact of sudden accelerations and decelerations.

The foregoing and other objects, advantages and features of this invention will hereinafter appear, and for purposes of illustration, but not of limitation, an exemplary embodiment of the subject invention is shown in the various views of the appended drawing.

DETAILED DESCRIPTION

In the description which follows, a preferred embodiment of the invention is disclosed in combination with a self-powered seagoing vessel or ship of the type suitable for drilling at sea; however, in its broadest aspects, the invention may be practiced in combination with any floating platform.

Figure 1:
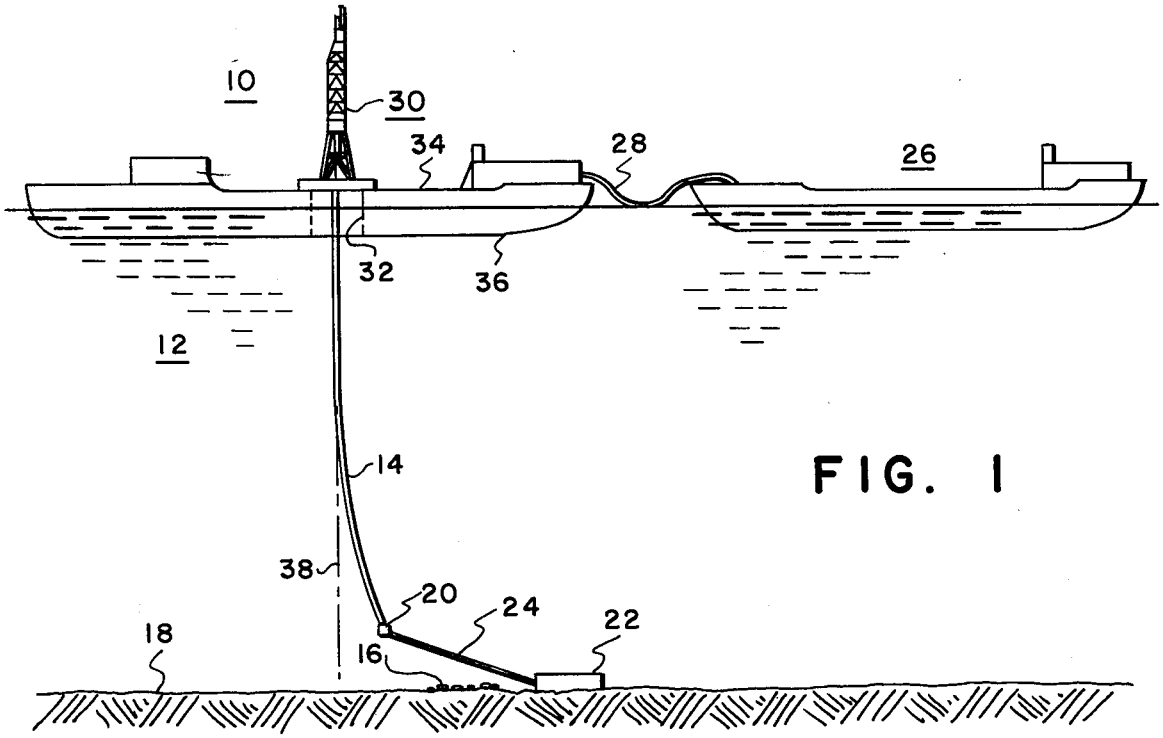
FIG. 1 is a schematic view illustrating the overall arrangement of a deep ocean mining vessel and the associated collecting apparatus.

Referring now to FIG. 1, a deep ocean mining vessel 10 is shown in a maneuvering position in a large body of water 12 which may be for example the Pacific Ocean. Suspended from the deep ocean mining vessel 10 into the ocean 12 is a pipe string 14 for conveying mineral nodules 16 from the ocean floor 18 to the hold of the mining vessel 10. A coupling member 20 is secured to the lower extremity of the pipe string 14 to maintain the pipe string in substantially vertical alignment as the mining vessel 10 maneuvers across the mining field. The pipe string 14 is connected to a dredge head 22 by means of a boom 24, one end of which is joined to the coupling member 20. The nodules 16 are gathered by the dredge 22 and are conveyed in a slurry of seawater and sediment through the pipe string 14 by a vacuum force which is induced in the pipe line 16 by injecting air at a predetermined level along the upper end of the pipe string. The nodules 16 which are gathered by the pipe string 14 are transferred from the mining vessel 10 into an ocean transport vessel 26 by any suitable means such as a floating conveyor line 28.

The mining vessel 10 is preferably provided with some buffer storage for the collected nodules. The slurry conveyed by the pipe string 14 which contains the nodules 16 is pumped through the pipe string and arrives at the surface with a typical concentration of nodules of approximately 15 percent by weight. Although the nodule slurry will usually be pumped directly into the ocean transport vessel 26, buffer storage will sometimes be required to sustain continuous mining operations after the departure of a fully loaded ocean transport vessel 26 while awaiting the arrival of an empty ocean transport vessel.

The deep ocean mining vessel 10 typically may have an overall length of approximately 600 feet and a beam of 100 feet and a full load displacement of approximately 47,000 tons. The roll period of the ship is typically 13 to 15 seconds. The mining vessel 10 is provided with internal ballast to limit roll in the athwartship direction to plus or minus 23 degrees and pitch is limited to plus or minus 13 degrees in the fore-aft direction.

Figure 2:
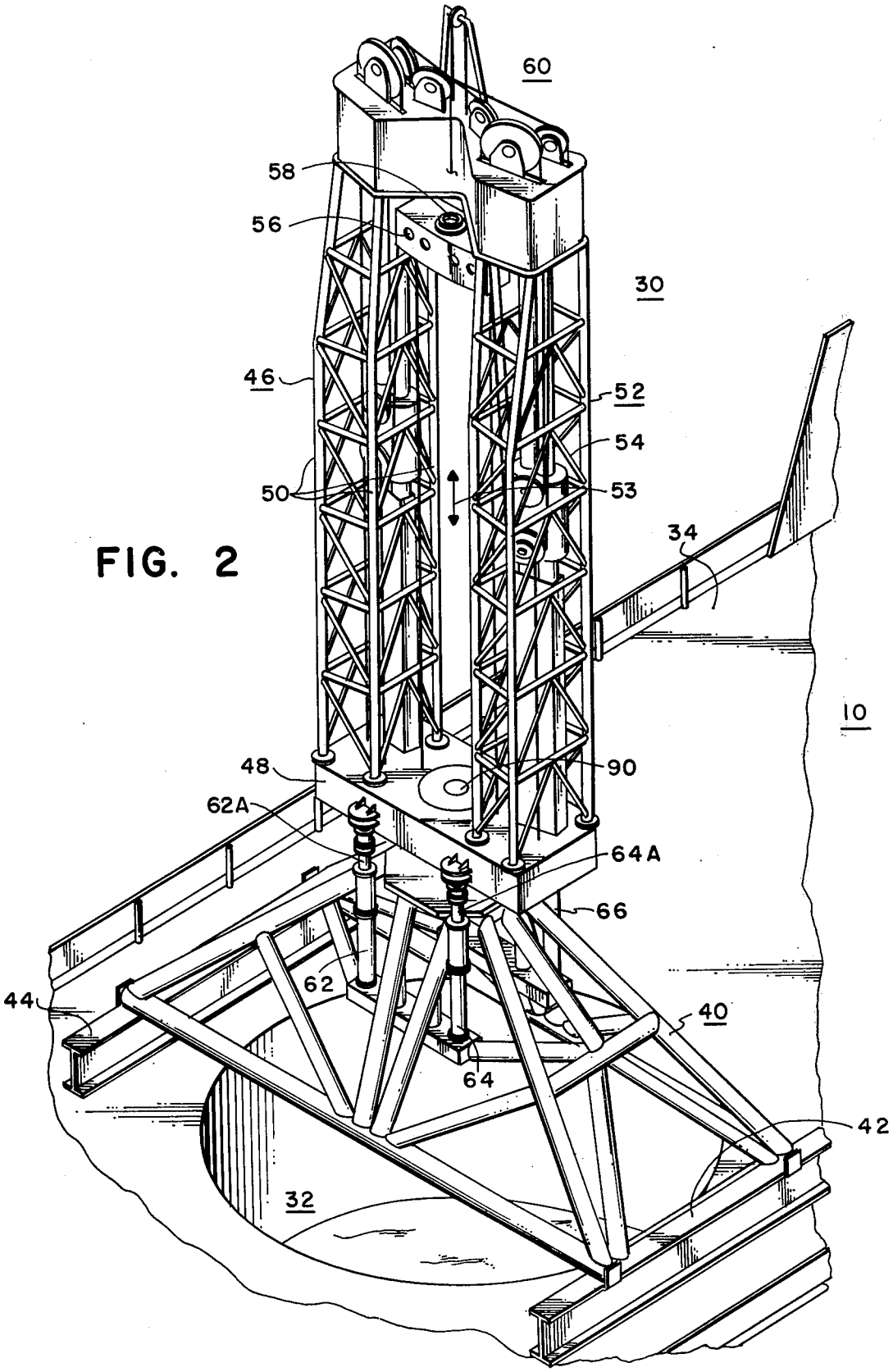
FIG. 2 is an isometric view of a stabilized hoist rig mounted on the vessel of FIG. 1.

Referring now to FIG. 1 and FIG. 2, pipe handling is provided by a hoist rig 30 which is disposed above a moon pool 32 which extends vertically through the deck 34 and hull 36 of the mining vessel 10 to permit access to the ocean beneath the vessel. The pipe string 14 is shown projecting vertically through the moon pool 32 in pendulous suspension from the hoist rig 30 substantially along the dashed line 38 which illustrates the nominal axis of the pipe string in the absence of transverse loading. As the dredge head 22 traverses the ocean floor 18 in gathering the nodules 16, a bending moment is induced in the pipe string 14 which causes it to deflect slightly from its resting position.

The construction of the hoist rig 30 is shown in greater detail in FIG. 2 of the drawing. The hoist rig 30 comprises generally a truss substructure 40 which is secured to a pair of rails 42, 44 located on either side of the moon pool 32 for accurate positioning of the hoist rig 30 over the moon pool. The substructure 40 is slideably engaged with the rails 42, 44 so that it may be retracted from the moon pool area to permit deployment or recovery of the dredge head 22.

The hoist rig 30 also includes a mast superstructure 46 secured to a base member 48. The mast structure 46 is defined by four tubular upstanding members 50 which are generally arranged at the corners of a square and are secured to the base member 48. A substantially identical mast section 52 is also secured to the base member 48 and is spaced apart from the mast section 46 to define a pipe handling zone 53. Each mast 46, 52 is provided with adequate structural cross-bracing members 54 to ensure rigidity of the structure. For increased structural strength, the tubular members 50 of the mast structures 46, 52 may be pressurized with hydraulic fluid in the manner as disclosed and claimed in U.S. Pat. No. 3,960,360.

A traveling block 56 is vertically guided through the pipe handling zone 53 defined between the two mast structures 46, 52. The traveling block 56 is reciprocated along the front legs of the mast structures which serve as guides. A rotary table 58 is carried by the traveling block 56 to facilitate pipe stabbing and removal operations. The power to raise and lower the traveling block 56 is provided by a hydraulic cylinder and is transmitted to the block by a cable arrangement indicated generally at 60. The rotary table 58 includes a conventional slip bowl and jaws for engaging a section of pipe to be stabbed into the pipe string 14 during a lowering operation or to be removed from the pipe string during a lifting operation.

According to an important feature of the present invention, the hoist rig 30 is dynamically supported with respect to the vessel 10 by hydraulic power means 62, 64, 66 and 68 which are preferably hydraulic linear actuators each of which include a piston portion 62A, 64A, 66A, and 68A, respectively. Each of the pistons move and apply a vertical displacement force to the base member 48 in response to changes in the pressure of hydraulic fluid contained within the actuators.

The mast assembly 46, 52 can accommodate a 48-foot stroke of the traveling block 58 to allow adequate clearance for a 45-foot joint of pipe. The mast is conservatively designed for a maximum pipe load of 1.6 million pounds.

Figure 3:
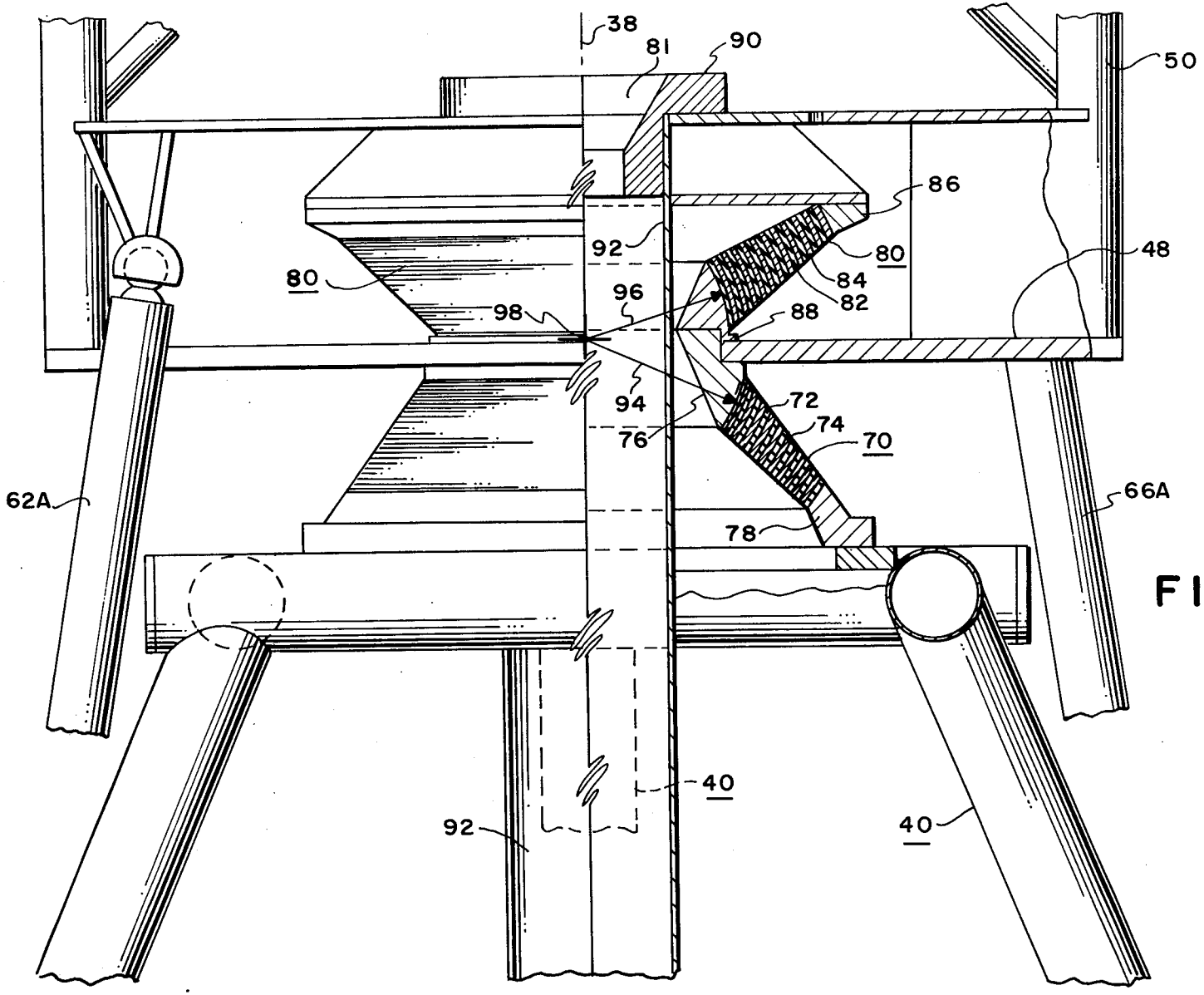
FIG. 3 is a view, partly in section, of a bearing apparatus for supporting the hoist rig shown in FIG. 2.

Referring now to FIG. 3 of the drawing, a bearing structure for supporting the pipe string in pendulous suspension from the hoist rig is illustrated. The bearing structure comprises generally a resilient bearing member 70 which is disposed in load supporting relation intermediate the truss substructure 40 and the base member 48. The bearing member is an annular sector of a substantially spherical laminated body of superposed layers of an elastic material 72 and a relatively inelastic material 74. The purpose of the bearing member 70 is to permit angular displacement of the base member 48 and of the hoist rig 30 with respect to the deck 34 of the vessel 10 to maintain substantially parallel alignment of the mast structure 46, 52 with the vertical axis 38 of the pipe string as the vessel rolls and pitches in response to wave movements of the ocean 12. The elastic layer 72 is preferably formed of an elastomer such as rubber and the relatively inelastic layer 74 is preferably formed of a metal such as steel which in combination are capable of supporting a working compressive load in excess of the pipe string weight. Such bearings have been constructed and used to support loads up to 16 million pounds. The resilient bearing member 70 is confined intermediate of first and second annular collar members 76, 78 which are suitably secured to the base member 48 and the truss substructure 40, respectively.

In a preferred embodiment of the present invention, a second bearing member 80 is disposed intermediate the base member 48 and a floating slip bowl 81. The second resilient bearing member 80 is substantially identical in construction to the first bearing member 70 and is formed of superposed layers 82 of an elastic material such as rubber and a layer 84 of a relatively inelastic material such as steel. One important function of the second resilient bearing member 80 is to provide a passive bearing member to serve as a shock absorber during the dynamic pipe handling mode of operation. This function is important in order to minimize the axial tension loading imposed upon the pipe string by the acceleration and deceleration of the pipe string as it is lowered into the ocean as a new length of pipe is stabbed into the pipe string 14 or as it is lifted from the ocean and brought to a stop so that a length of pipe may be removed from the pipe string. Sudden jarring stops can easily over-stress the pipe string 14 in tension thereby causing premature failure. Although the hoisting rig is designed to provide smooth deceleration as the pipe string contacts the rig floor, for further safety the second resilient bearing member 80 is incorporated into the bearing structure to provide additional shock absorbing means into the rig floor in case of rig malfunction. A second important function of the passive bearing member 80 is to serve as a resilient gimbal in a nonpowered mode of operation after the pipe string has been lowered to the proper depth for mineral mining operations. During this time the pipe string may simply be supported by the resilient bearing member 80 with the base member 48 locked into a fixed position, for example in a horizontal position with respect to the deck 34, by locking the hydraulic actuators 62–68.

The resilient bearing 80 is confined intermediate first and second collar members 86, 88 which are secured to a shoulder portion 90 of the slip bowl 81 and the base member 48, respectively. A tail pipe weldment 92 is secured in concentric alignment with the slip bowl 81 and the axis 38 of the pipe string 14 to serve as a guide for the pipe to prevent inadvertent engagement with the resilient bearing members 70, 80 during pipe stabbing and removal operations. The slip bowl 81 supports the pipe string in combination with a selectively engageable pipe elevator and lifting dogs (not shown) carried by the traveling block 56 which grip a convenient portion of the pipe string, for example a tool joint defined by the union of two pipe joints.

The bearing members 70, 80 are annular sectors of substantially spherical form wherein the superposed layers of rubber and steel have a radius of curvature 94, 96 respectively. The bearing members 70, 80 are preferably concentrically aligned along the common axis 38 and each have an origin of curvature which is disposed substantially along the common axis 38. In a preferred embodiment, the origin of curvature of the first spherical bearing member 70 is substantially coincident with the origin of curvature of the second spherical bearing member at the point 98. The point 98 coincides with the axis of rotation of the pipe string 14 as it is supported by the two resilient bearings. This arrangement is desirable in order to maximize the amount of roll and pitch angular displacement of the pipe string through the center of rotation 98.

It has been determined that a number of parameters of the spherical laminar resilient bearing members 70, 80 can be modified to give different combinations of the axial, radial, and rotational spring moduli. The parameters include the physical shape of the bearing, the thickness of the elastic and inelastic lamina, the physical properties of the elastic material, and the radius of curvature of the laminae. In general, the dynamic positioning bearing 70 has relatively high spring moduli as compared to those of the passive bearing 80. For example, in one arrangement the axial spring modulus of the bearing 70 is fifteen million pounds/in., as compared to two million pounds/in. for the bearing 80. The lower dynamic bearing 70 should be relatively stiff in order to damp the motion of the hoist rig 30 as the base member 48 is moved angularly by the hydraulic actuators 62–68 in response to roll and pitch movements of the vessel 10. The upper resilient bearing member 80 should be relatively limber in the passive support mode so that it functions essentially as a ball joint to allow the vessel and hoist rig to move freely about the slip bowl 81 when the base member 48 is locked into position, for example during mining operations.

It should be understood that the passive bearing member 80 is not essential to the proper operation of the hoist rig because it is possible to dynamically position the hoist rig with respect to the pipe string at all times, including during mining operations when the pipe string is trailing at a slight angle with respect to the nominal vertical axis 38. However, after the pipe string 14 has been launched to the proper depth, it is economical to turn off the hydraulic actuators and lock them into a fixed position and let the pipe string hang freely from the slip bowl 81 with only the passive bearing 80 providing the support.

Figure 4:
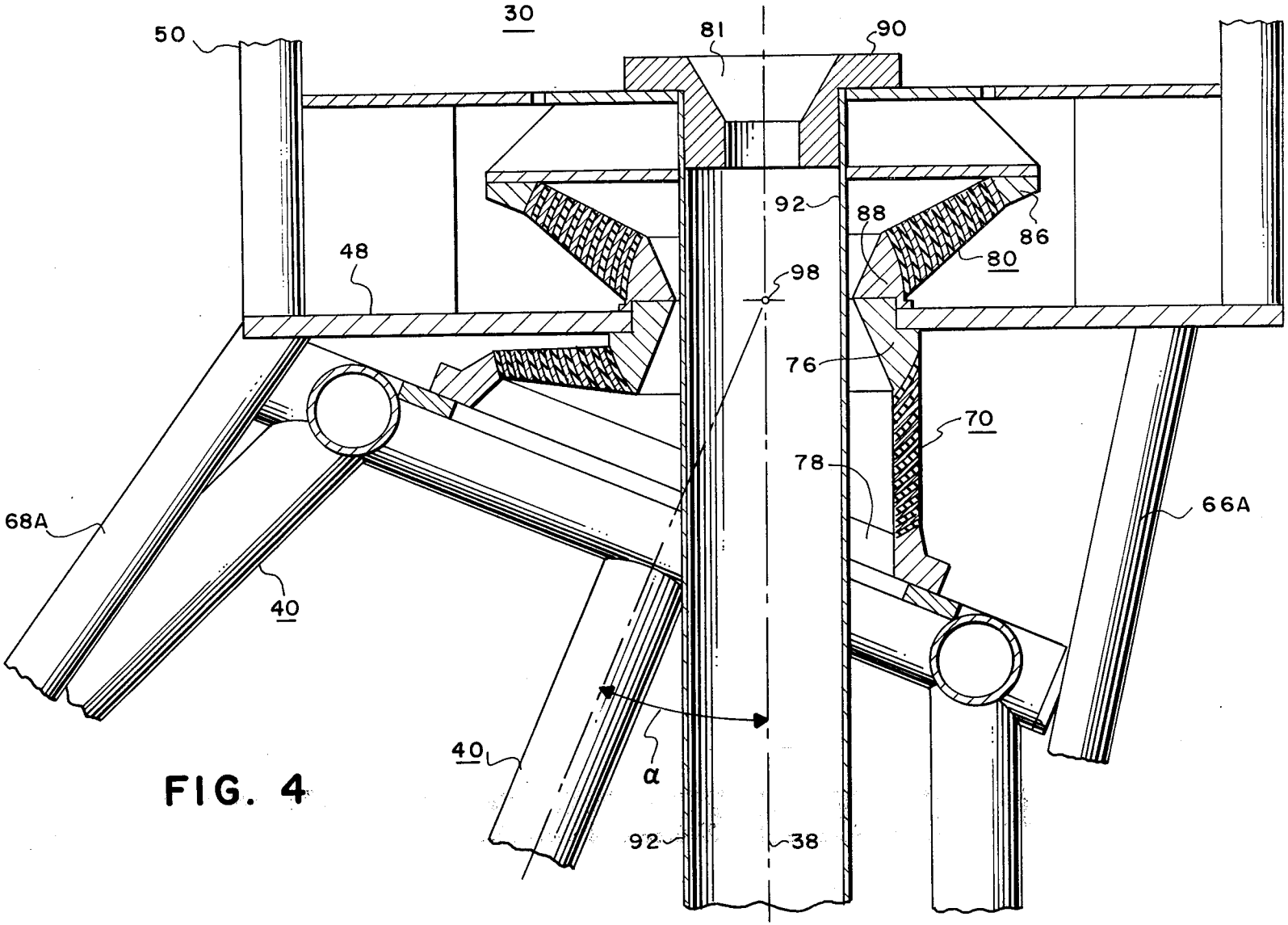
FIG. 4 is a view similar to FIG. 3 which illustrates the maximum displacement of the bearing structure in the dynamic positioning mode of operation.

Illustration of the displacement of the hoist rig 30 by an angle alpha ($\alpha$) with respect to the axis of the pipe string 38 is illustrated in FIG. 4 of the drawing. In the dynamic positioning mode, only the lower bearing member 70 disposed between the truss substructure 40 and the base member 48 is angularly deformed as the hydraulic actuators 62–68 move in response to position control signals, which will be described in detail hereinafter.

Figure 5:
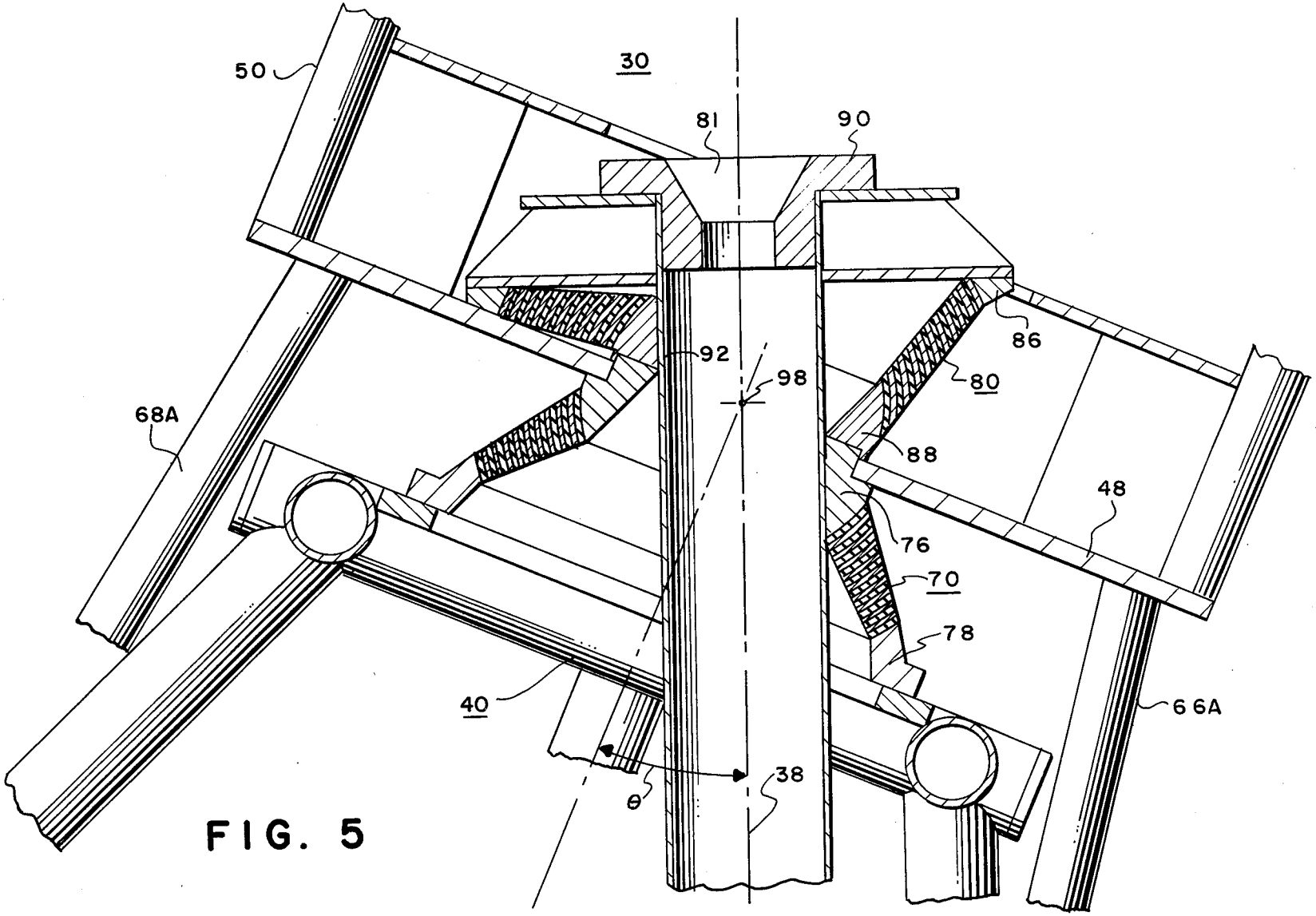
FIG. 5 is a view similar to FIG. 3 which illustrates the maximum displacement of the bearing structure in the passive positioning support mode of operation; and, FIG. 6 is a combined electrical and hydraulic schematic diagram which illustrates a preferred embodiment of a power control system for dynamically positioning the hoist rig illustrated in FIG. 2.

In FIG. 5, displacement of the hoist rig 30 and the truss substructure 40 relative to the axis 38 of the pipe string 14 by an angle theta ($\theta$) is illustrated. In this passive positioning mode, the load of the pipe string is transmitted through the upper bearing member 80 and is distributed equally through the bearing member 70 because the hydraulic actuators 62–68 are locked to orient the base member 48 in a predetermined position with respect to the deck of the vessel 10. Therefore in the passive positioning mode, only the upper resilient bearing is deformed as the vessel pitches and rolls. During the time that the pipe string is hanging from the hoist rig 30 and is performing mining operations, the passive positioning arrangement is attractive since no power system is required to maintain the pipe string 14 with nominally zero bending moment.

Figure 6:
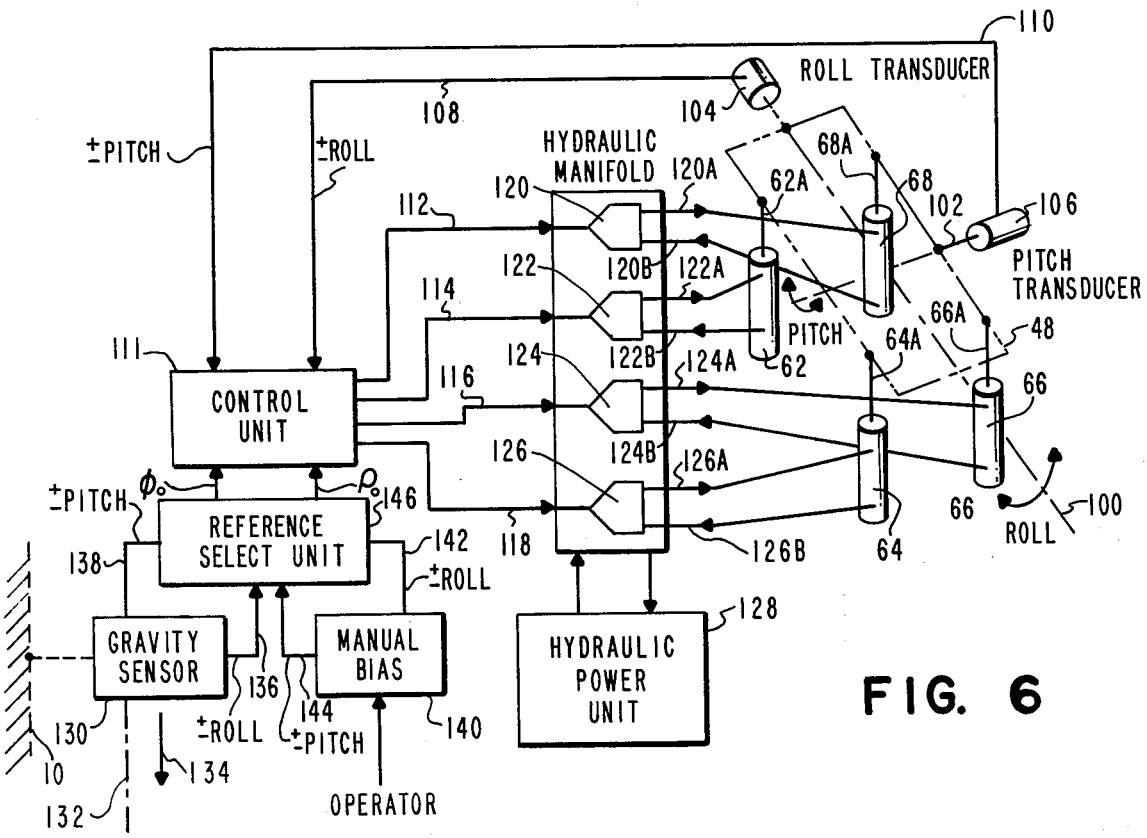

Referring now to FIG. 6 of the drawing, the dynamic positioning of the base member 48 is made possible by an electromechanical servomechanism control system which is operatively connected to the base member 48 to cause it to move angularly about its roll axis 100 and pitch axis 102 to maintain alignment of the mast structure 46, 52 with respect to the axis 38 of the pipe string 14. The system includes a roll transducer 104 and a pitch transducer 106 for generating first and second electrical attitude signals 108, 110 respectively which are proportional to the roll and pitch angular displacements of the base member 48 as measured with respect to a predetermined reference axis. In a preferred embodiment of the invention, the predetermined reference axis is the axis 38 of the pipe string 14. In an alternate embodiment, the predetermined reference axis is a line parallel to the local gravity vector. Also included in the control system is an electronic control unit 111 which is operable to generate electrical position correction signals 112–118 which are proportional to a predetermined function of the attitude signals 108, 110. The position correction signals 112–118 are electrically connected to control valves 120–126 which control the flow of pressurized hydraulic fluid from a hydraulic power unit 128 through a system of charge and return lines 120A, 120B–126A, 126B connected to the linear actuators 62–68.

The pitch and roll transducers 104 and 106 may be pendulous, gravity-referenced angular displacement sensors which are secured to the base member 48 substantially along its roll axis 100 and pitch axis 102, respectively. These transducers are relatively simple and are essentially a plumb bob having an electrical output which can replace more complex and expensive gyroscopic instruments which perform similar functions. However, they may not be entirely suitable for some applications because of their sensitivity to interfering translatory acceleration inputs. If a more stable positioning system is desired, the roll and pitch transducers may simply be relative displacement transducers which are secured to the base member 48 substantially along its roll and pitch axes 100, 102, respectively, with the relative displacement transducers being oriented with respect to the platform to provide electrical signal outputs which are referenced to an arbitrary roll and pitch displacement of the base member with respect to the vessel 10. In this arrangement, the relative roll and pitch signals 108, 110 provided by the transducers are subtracted from gyro-stabilized roll and pitch signals which are provided by a vertical gyro gravity sensor 130 which may be mounted on the vessel 10 with its spin axis 132 oriented in parallel with the local gravity field 134 for providing roll and pitch output signals 136, 138 porportional to the roll and pitch angular displacement of the vessel 10 relative to the local gravity field 134. The control unit 111 includes conventional circuit means (not shown) for forming the difference between the attitude signals 108, 110 and the gyro roll and pitch signals 136, 138, respectively to derive the position control signals 112–118.

In yet another arrangement, the gravity-referenced sensor 130 may be mounted directly to the dynamically supported hoist rig 30 for providing roll and pitch output signals 136, 138 which are proportional to the roll and pitch of the mast superstructure 46, 52 relative to the local gravity field. For this arrangement, the control unit 111 includes conventional circuit means (not shown) for generating the position correction signals 112–118 in proportion to the difference between the base member roll and pitch signals 108, 110 and the gravity-referenced sensor roll and pitch output signals 136, 138, respectively. The gravity-referenced sensor 130 is preferably a vertical gyro mounted directly to the hoist rig 30 and having its spin axis aligned in parallel with the local gravity field 134. However, the gravity-referenced sensor 130 may comprise a pair of pendulous, angular displacement sensors with the planes of motion of the pendulous mass of each sensor being oriented substantially at right angles with respect to each other and substantially in alignment with the pitch and roll axes of the vessel.

It is desirable in some instances to provide for manual control by an operator who is observing the pipe string launching or retrieving operation. Accordingly, the control system includes a manual bias control unit 140 which generates artificial roll and pitch bias signals 142, 144 in response to manual control commands by the operator. The artificial roll and pitch signals 142, 144 are selectively connected as inputs to the control unit 111 by means of a reference-select unit 146 to permit manual override control of the platform attitude by the operator. The selected reference provides reference roll and pitch signals rho ($\rho$) and phi ($\phi$).

Thus, the present invention provides a versatile and robust positioning system for maintaining substantially parallel alignment of the mast structure of a hoist rig with the vertical axis of the pipe string to minimize the bending stress induced in the pipe string by the roll and pitch of the vessel. This advantage is made possible by a spherical resilient bearing arrangement which also serves as a shock absorbing mechanism which cooperates with the traveling block of the hoist rig to minimize the axial tension stresses induced into the pipe string by acceleration and deceleration forces associated with the pipe handling mode of operation as the pipe is lowered into the ocean or as it is retrieved from the ocean and is brought to rest. This bearing arrangement therefore permits mining operations to be carried out at greater ocean depths and in heavier seas than has been possible with conventional ocean mining vessels.

The particular details of construction disclosed herein are, of course, only illustrative and other equivalent structures may be utilized without departing from the scope of the invention as defined by the appended claims.

What is claimed is:

1. A stabilized hoist rig for lowering, lifting, and supporting a pipe string from a platform floating in a deep ocean, the platform being of the type including a deck and having a well opening extending therethrough providing access to the ocean beneath the platform, the hoist rig comprising, in combination:

a vertically extending mast structure having a base member disposed over the well opening for supporting the pipe string as it hangs pendulously in the ocean, hoist means for traversing the mast structure including means for engaging a section of pipe to be stabbed into the pipe string during a lowering operation or to be removed from the pipe string during a lifting operation;

first power means operatively connected to the hoist means to selectively raise and lower the same;

a first bearing member disposed intermediate the base member and the deck and in load supporting engagement with the base member for permitting angular displacement of the base member about its roll and pitch axes with respect to the pipe string;

second power means operatively connected to the base member for moving it angularly about the first bearing member to maintain substantially parallel alignment of the mast structure with the vertical axis of the pipe string as the floating platform rolls and pitches in response to wave movements of the ocean in a dynamic support operating mode;

slip bowl means having a shoulder portion for supporting a peripheral surface portion of the pipe string;

a second bearing member disposed intermediate the slip bowl meansand the base member and in load supporting engagement with the slip bowl means for permitting angular displacement of the base member about its roll and pitch axes relative to the slip bowl; and, means for locking the base member in a fixed position relative to the platform for permitting the mast structure to roll and pitch with respect to the slip bowl in response to movements of the ocean in a passive support operating mode.

2. The hoist rig as defined in claim 1 wherein the first and second bearings each comprise an annular section of a substantially spherical laminated body of superposed layers of an elastic material and a relatively inelastic material, the annular sections each being disposed substantially concentrically about a common center of rotation.

3. The hoist rig as defined in claim 2 wherein the elastic material comprises an elastomer and the inelastic material comprises steel.

4. The hoist rig as defined in claim 2 wherein the spring modulus of the first bearing member is substantially greater than the spring modulus of the second bearing member.

5. A structure for supporting a pipe string in pendulous suspension from the slip bowl of a hoist rig in a deep ocean mining vessel comprising, in combination:

a first resilient bearing member disposed in load supporting relation intermediate the vessel and the hoist rig;

a second resilient bearing member disposed in load supporting relation intermediate the hoist rig and the slip bowl; and, power means for angularly displacing the hoist rig with respect to the vessel to maintain vertical alignment of the hoist rig with the pipe string as the vessel rolls and pitches during pipe stabbing and removal operations performed during lowering and lifting of the pipe string.

6. The structure as defined in claim 5 wherein the power means is operable to lock the hoist rig in a fixed position relative to the vessel during mining operations.

7. The structure as defined in claim 5, the first and second resilient bearing members comprising, respectively:

a first annular section of a substantially spherical laminated body of superposed layers of elastic material and a relatively inelastic material disposed intermediate first and second annular collars;

a second annular sector of a substantially spherical laminated body of superposed layers of elastic material and a relatively inelastic material disposed intermediate first and second annular collars;

the first and second annular collars of the first bearing being secured in engagement with the vessel and the hoist rig, respectively;

the first and second annular collars of the second bearing member being secured in engagement with the hoist rig and slip bowl, respectively; and, the first and second bearing members being substantially concentrically aligned along a common axis and each having an origin of curvature disposed substantially along the common axis.

8. The structure as defined in claim 7 wherein the origin of curvature of the first spherical bearing member is substantially coincident with the origin of curvature of the second spherical bearing member.

9. The structure as defined in claim 7 including a cylindrical tail pipe weldment for receiving one end of the pipe string mechanically secured to the slip bowl and projecting through the collars of the first and second bearing members.

10. In a seagoing vessel of the type including a well opening extending vertically through its deck and hull to permit lowering and lifting operations in the sea beneath the vessel, a platform disposed over the well opening for supporting a pipe string in pendulous suspension through the well opening, and a bearing member disposed intermediate of the platform and vessel and in load supporting engagement with the platform for permitting angular movement of the platform about its roll and pitch axes relative to the vessel, the combination of electromechanical control means operatively connected intermediate the platform and vessel for moving the platform angularly about its roll and pitch axes to maintain a predetermined angular displacement of the platform with respect to the axis of a pipe string supported by the platform as the vessel rolls and pitches, said electromechanical control means comprising:

electromechanical transducer means for generating first and second electrical attitude signals proportional to the roll and pitch angular displacements, respectively, of the platform as measured with respect to a predetermined reference axis, the electromechanical transducer means including a vertical gyro mounted on the platform, the gyro having its vertical spin axis oriented in parallel with the local gravity field;

electronic control circuit means for generating first and second position correction signals proportional to a predetermined function of the first and second attitude signals; respectively, first hydraulic actuator means having a first piston assembly operatively connected to angularly displace the platform about its roll axis relative to the vessel in response to the first position correction signal; and second hydraulic actuator means having a second piston assembly operatively connected to angularly displace the platform about its pitch axis relative to the vessel in response to the second position correction signal.

11. The combination as defined in claim 10 wherein the electromechanical transducer means comprises first and second pendulous, gravity-referenced angular displacement sensors secured to the platform, the planes of motion of the pendulous mass of each sensor being oriented substantially at right angles with respect to each other and substantially in alignment with the pitch and roll axes of the platform.

12. In a seagoing vessel of the type including a well opening extending vertically through its deck and hull to permit lowering and lifting operations in the sea beneath the vessel, a platform disposed over the well opening of supporting a pipe string in pendulous suspension through the well opening, and a bearing member disposed intermediate of the platform and vessel and in load supporting engagement with the platform for permitting angular movement of the platform about its roll and pitch axes relative to the vessel, the combination of electromechanical control means operatively connected intermediate the platform and vessel for moving the platform angularly about its roll and pitch axes to maintain a predetermined angular displacement of the platform with respect to the axis of a pipe string supported by the platform as the vessel rolls and pitches, said electromechanical control means comprising:

electromechanical transducer means for generating first and second electrical attitude signals proportional to the roll and pitch angular displacements, respectively, of the platform as measured with respect to a predetermined reference axis, the electromechanical transducer means including first and second relative displacement roll and pitch transducer secured to the platform substantially along its roll axis and pitch axis, respectively, the transducers being oriented with respect to the platform to provide electrical signal outputs which are referenced to an arbitrary roll and pitch displacement of the platform with respect to the vessel, and further including a vertical gyro mounted on the vessel with its spin axis oriented in parallel with the local gravity field for providing roll and pitch output signals proportional to the roll and pitch angular displacement of the vessel relative to the local gravity field;

electronic control circuit means for generating first and second position correction signals proportional to a predetermined function of the first and second attitude signals, respectively, first hydraulic actuator means having a first piston assembly operatively connected to angularly displace the platform about its roll axis relative to the vessel in response to the first position correction signal; and, second hydraulic actuator means having a second piston assembly operatively connected to angularly displace the platform about its pitch axis relative to the vessel in response to the second position correction signal.

13. In a seagoing vessel of the type including a well opening extending vertically through its deck and hull to permit lowering and lifting operations in the sea beneath the vessel, a platform disposed over the well opening for supporting a pipe string in pendulous suspension through the well opening, and a bearing member disposed intermediate of the platform and vessel and in load supporting engagement with the platform for permitting angular movement of the platform about its roll and pitch axes relative to the vessel, the combination of electromechanical control means operatively connected intermediate the platform and vessel for moving the platform angularly about its roll and pitch axes to maintain a predetermined angular displacement of the platform with respect to the axis of a pipe string supported by the platform as the vessel rolls and pitches, said electromechanical control means comprising:

electromechanical transducer means for generating first and second electrical attitude signals proportional to the roll and pitch angular displacements, respectively, of the platform as measured with respect to a predetermined reference axis;

electronic control circuit means for generating first and second position correction signals proportional to a predetermined function of the first and second attitude signals, respectively;

bias means for generating artificial roll and pitch bias signals in response to manual control by an operator, the roll and pitch bias signals being selectively connected to the electronic control circuit means to permit manual control of the platform attitude by the operator, first hydraulic actuator means having a first piston assembly operatively connected to angularly displace the platform about its roll axis relative to the vessel in response to the first position correction signal; and second hydraulic actuator means having a second piston assembly operatively connected to angularly displace the platform about its pitch axis relative to the vessel in response to the second position correction signal.

* * * * *

UNITED STATES PATENT AND TRADEMARK OFFICE

CERTIFICATE OF CORRECTION

PATENT NO. : 4,200,054

DATED : April 29, 1980

INVENTOR(S) : Thomas L. Elliston

It is certified that error appears in the above—identified patent and that said Letters Patent is hereby corrected as shown below:

Column 1, line 22 "of" first occurrence should be -- or --.

Column 2, line 4, "jaring" should be -- jarring --.

Column 11 line 49, "of" should be -- for --.

Column 12, line 1, "transducer" should be -- transducers --.

Signed and Sealed this

*Twenty-eighth* Day of *October 1980*

[SEAL]

*Attest:*

SIDNEY A. DIAMOND

*Attesting Officer*

*Commissioner of Patents and Trademarks*